US006251850B1

(12) United States Patent
Clarke et al.

(10) Patent No.: US 6,251,850 B1
(45) Date of Patent: Jun. 26, 2001

(54) FABRIC SOFTENING COMPOSITIONS CONTAINING EMULSIFIED SILICONE

(75) Inventors: David Ellis Clarke, Bromborough (GB); Serge Firmin Creutz, Liege; Benoit Henault, Oppem, both of (BE); Samantha Small, Port Sunlight (GB)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/570,864

(22) Filed: May 15, 2000

(30) Foreign Application Priority Data

May 21, 1999 (GB) ..... 9911942
Jun. 18, 1999 (GB) ..... 9914266

(51) Int. Cl.[7] ..... C11D 1/38; C11D 3/37
(52) U.S. Cl. ..... 510/527
(58) Field of Search ..... 510/527

(56) References Cited

U.S. PATENT DOCUMENTS 4,946,624 * 8/1990 Michael ..... 252/315.2
6,013,682 * 1/2000 Dalle et al. ..... 516/55
6,114,299 * 9/2000 Hunter et al. ..... 510/466

FOREIGN PATENT DOCUMENTS 0 285 391 10/1988 (EP) .
0 356 210 2/1990 (EP) .
0 544 493 6/1993 (EP) .
0 661 398 7/1995 (EP) .
0 789 070 8/1997 (EP) .
91/19037 12/1991 (WO) .
95/11746 5/1995 (WO) .
95/24460 9/1995 (WO) .
96/15309 5/1996 (WO) .
97/31997 4/1997 (WO) .
97/31998 9/1997 (WO) .

OTHER PUBLICATIONS

International Search Report dated May 8, 2000.

* cited by examiner

*Primary Examiner*—John Hardee

(57) ABSTRACT

A fabric softening composition comprising:

(a) a cationic fabric softening compound; and (b) an emulsified silicone.

In one aspect the viscosity of the silicone before emulsification is from 10,000 cSt to 1,000,000 cSt, preferably from 30,000 cSt to 750,000 cSt, more preferably from 40,000 cSt to 400,000 cSt, most preferably 45,000 cSt to 250,000 cSt, eg 45,000 cSt to 200,000 cSt and the emulsion is a macro-emulsion. In another aspect, the median silicone droplet size in the emulsion is at least 0.2 $\mu$m, preferably at least 0.25 $\mu$m, more preferably at least 0.39 $\mu$m, preferably also no greater than 25 $\mu$m and is emulsified with an emulsifier comprising one or more cationic surfactants.

14 Claims, No Drawings

FABRIC SOFTENING COMPOSITIONS CONTAINING EMULSIFIED SILICONE

TECHNICAL FIELD

The present invention relates to fabric softening compositions which provide additional benefits to the fabric, particularly improved crease reduction and/or ease of ironing.

BACKGROUND AND PRIOR ART

Fabric softener compositions, especially those added in the rinse, are well known. It is also known to incorporate one or more additional materials such as silicones, to reduce wrinkling of the fabric during the rinsing and drying stages of the wash. For example WO-A-96/15309 discloses the use of a combination of a silicone and a film-forming polymer for this purpose. Typical silicones in this application are polydiorganosiloxanes. Nevertheless, there remains a need in fabric softening compositions to formulate with additives which not only reduce the appearance of wrinkles or creases before ironing, but also make ironing easier.

In many prior art compositions, the silicones are incorporated in the form of an emulsion, which is a micro-emulsion, that is to say the silicone is present as liquid droplets having a droplet size less than the wavelength of visible light and so the emulsion is substantially transparent. However, in a few cases, they are macro-emulsions (e.g. WO-A-97/31997 and '98). The silicones before emulsification are those having relatively low viscosities, because it is assumed that those with higher viscosities are more difficult to handle during the process of manufacturing the product and are less suited for anti-creasing performance. WO-A-95/24460 discloses a fabric softening composition which contains from about 0.2% to about 20% of a polydimethyl siloxane having a viscosity from about 2 to 5,000 centi-Stokes (cSt).

It has now been discovered that, surprisingly, good anti-creasing and/or ease of ironing can be achieved by formulating with a silicone which is incorporated in the form of a macro-emulsion and which silicone has a viscosity of from 10,000 cSt to 1,000,000 cSt, and/or the emulsified silicone has a median droplet size of at least 0.2 $\mu$m and is emulsified with at least one cationic surfactant.

Definition of the Invention

Thus according to a first aspect of the invention there is provided a fabric softening composition comprising:

(a) a cationic fabric softening agent; and (b) an emulsified silicone;

wherein the viscosity of the silicone before emulsification is from 10,000 cSt to 1,000,000 cSt, preferably from 30,000 cSt to 750,000 cSt, more preferably from 40,000 cSt to 400,000 cSt, most preferably 45,000 cSt to 250,000 cSt, eg, 45,000 cSt to 200,000 cSt, and the emulsion is a macro-emulsion.

A second aspect of the present invention provides a fabric softening composition comprising:

(a) a cationic fabric softening agent; and (b) an emulsified silicone;

wherein the median droplet size of the silicone in the emulsion is 0.2 $\mu$m, preferably at least 0.25 $\mu$m, more preferably at least 0.39 $\mu$m, preferably also no greater than 25 $\mu$m and is emulsified with an emulsifier comprising one or more cationic surfactants.

A third aspect of the present invention provides a method of manufacturing a fabric softening composition, the method comprising obtaining a macro-emulsion of a silicone having a viscosity of from 10,000 cSt to 1,000,000 cSt and admixing said macro-emulsion with a cationic fabric softening agent.

A fourth aspect of the present invention provides a method of manufacturing a fabric softening composition, the method comprising obtaining the emulsion in the form of an emulsion of a silicone having a viscosity of from 10,000 cSt to 1,000,000 cSt, preferably from 30,000 cSt to 750,000 cSt, more preferably from 40,000 cSt to 400,000 cSt, most preferably 45,000 cSt to 250,000 cSt, eg 45,000 cSt to 200,000 cSt the median droplet size of the silicone in the emulsion being at least 0.2 $\mu$m, preferably at least 0.25 $\mu$m, more preferably at least 0.39 $\mu$m, preferably also no greater than 25 $\mu$m and is emulsified with an emulsifier comprising one or more cationic surfactants, and admixing said emulsion with a cationic fabric softening agent.

Compositions according to the present invention may optionally embody both the first and second aspects of the present invention and processes for their manufacture optionally may embody the third and fourth aspects. A method of using a composition according to the first and/or second aspects of the present invention by applying it to a fabric or textile for softening the fabric or textile, constitutes another aspect of the invention.

For the avoidance of doubt, in the context of the present invention, the term "emulsified silicone" means that the silicone is in emulsion form prior to incorporation in the fabric softening composition and does not necessarily remain in that form in the final product.

The cationic fabric softening agent may comprise one or more cationic fabric softening materials and the emulsified silicone may comprise one or more individual silicone materials.

DETAILED DESCRIPTION OF THE INVENTION

Cationic Fabric Softening Agents

Preferably, the cationic fabric softening agent is a quaternary ammonium material or a quaternary ammonium material containing at least one ester group. The quaternary ammonium compounds containing at least one ester group are referred to herein as ester-linked quaternary ammonium compounds.

As used herein the term 'ester group', when used as a group in the quaternary ammonium material, includes an ester group which is a linking group in the molecule.

It is preferred for the ester-linked quaternary ammonium compounds to contain two or more ester groups. In both monoester and the diester quaternary ammonium compounds it is preferred if the ester group(s) is a linking group between the nitrogen atom and an alkyl group. The ester group(s) is preferably attached to the nitrogen atom via another hydrocarbyl group.

Also preferred are quaternary ammonium compounds containing at least one ester group, preferably two, wherein at least one higher molecular weight group containing at least one ester group and two or three lower molecular weight groups are linked to a common nitrogen atom to produce a cation and wherein the electrically balancing anion is a halide, acetate or lower alkosulphate ion, such as chloride or methosulphate. The higher molecular weight substituent on the nitrogen is preferably a higher alkyl group, containing 12 to 28, preferably 12 to 22, e.g. 12 to 20 carbon atoms, such as coco-alkyl, tallowalkyl, hydrogenated tallowalkyl or substituted higher alkyl, and the lower molecular weight substituents are preferably lower alkyl of 1 to 4 carbon atoms, such as methyl or ethyl, or substituted lower alkyl. One or more of the said lower molecular weight substituents may include an aryl moiety or may be replaced by an aryl, such as benzyl, phenyl or other suitable substituents.

Preferably the quaternary ammonium material is a compound having two $C_{12}$–$C_{22}$ alkyl or alkenyl groups connected to a quaternary ammonium head group via at least one ester link, preferably two ester links or a compound comprising a single long chain with an average chain length equal to or greater than $C_{20}$.

More preferably, the quaternary ammonium material comprises a compound having two long chain alkyl or alkenyl chains with an average chain length equal to or greater than $C_{14}$. Even more preferably each chain has an average chain length equal to or greater than $C_{16}$. Most preferably at least 50% of each long chain alkyl or alkenyl group has a chain length of $C_{18}$. It is preferred if the long chain alkyl or alkenyl groups are predominantly linear.

The most preferred type of ester-linked quaternary ammonium material that can be used in compositions according to the invention is represented by the formula (A):

(A)

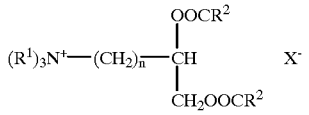

wherein each $R^1$ group is independently selected from $C_{1-4}$ alkyl, hydroxyalkyl or $C_{2-4}$ alkenyl groups; and wherein each $R^2$ group is independently selected from $C_{8-28}$ alkyl or alkenyl groups; $X^-$ is any suitable counter-ion, i.e. a halide, acetate or lower alkosulphate ion, such as chloride or methosulphate.

n is an integer from 1–5 or is 0

It is advantageous for environmental reasons if the quaternary ammonium material is biologically degradable.

Preferred materials of this class such as 1,2 bis[hardened tallowoyloxy]-3-trimethylammonium propane chloride and their method of preparation are, for example, described in U.S. Pat. No. 4,137,180. Preferably these materials comprise small amounts of the corresponding monoester as described in U.S. Pat. No. 4,137,180 for example 1-hardened tallowoyloxy-2-hydroxy-3-trimethylammonium propane chloride.

Another class of preferred ester-linked quaternary ammonium materials for use in compositions according to the invention can be represented by the formula (B):

(B)

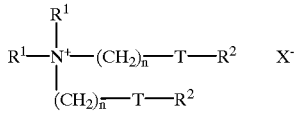

wherein $R^1$, n, $R^2$ and $X^-$ are as defined above.

and T is 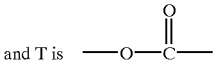 or 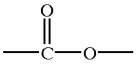 ; and

It is especially preferred that each $R^1$ group is methyl and each n is 2.

Of the compounds of formula (B), Di-(tallowyloxyethyl) dimethyl ammonium chloride, available from Hoechst, is the most preferred. Di-(hardened tallowyloxyethyl)dimethyl ammonium chloride, ex Hoechst and di-(tallowyloxyethyl) methyl hydroxyethyl methosulphate are also preferred.

Another preferred class of quaternary ammonium cationic fabric softening agent is defined by formula (C):

(C)

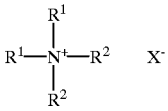

where $R^1$, $R^2$ and $X^-$ are as hereinbefore defined.

A preferred material of formula is di-hardened tallowdiethyl ammonium chloride, sold under the Trademark Arquad 2HT.

The optionally ester-linked quaternary ammonium material may contain optional additional components, as known in the art, in particular, low molecular weight solvents, for instance isopropanol and/or ethanol, and co-actives such as nonionic softeners, for example fatty acid or sorbitan esters.

The fabric softening agent is present in the composition preferably in a total amount of 0.5%–50% by weight based upon the total weight of the composition, more preferably 0.5% to 35%, more preferably 1–30%, more preferably 3–25%, most preferably 3–20%, eg 8–20%.

Emulsified Silicone

According to the first and third aspects of the present invention, in the emulsified silicone, the silicone droplets are incorporated to be in the form of a macro-emulsion, that is to say the droplets have a median size in the wavelength range corresponding to the visible spectrum, or even larger. Preferably, the emulsion is an oil-in-water emulsion. The term median size refers to the number average. The visible spectrum is 0.39 $\mu$m to 0.77 $\mu$m. In the emulsion, the silicone droplets are then preferably from 0.39 $\mu$m to 25 $\mu$m. In the second and fourth aspects of the present invention, in the emulsion, the silicone droplets have a median size of at least 0.2 $\mu$m, preferably at least 0.25 $\mu$m. The droplet size may be determined based on measurements of median DV05 using a Malvern X Mastersizer.

The silicone may be of any structure which gives rise to one or more of the desired benefits in use of the fabric softener formulation. Preferably, it has a linear structure. It is preferably a non-functional silicone, especially one which is non-amino functional. Typical silicones are siloxanes which have the general formula $R_aSiO_{(4-a)/2}$ wherein each R is the same or different and is selected from hydrocarbon and hydroxyl groups, 'a' being from 0 to 3 and in the bulk material; 'a' has an average value of from 1.85–2.2.

Most preferably, the silicone is a polydi-$C_{1-6}$alkyl (preferably a polydimethyl) siloxane end-terminated either by tri-$C_{1-6}$ alkylsilyl (e.g. trimethylsilyl) or hydroxy-di-$C_{1-6}$ alkylsilyl (e.g. hydroxy-dimethylsilyl) groups, or by both.

Certainly, in the case of compositions according to the first and third aspects of the present invention and preferably, in the case of compositions according to the second and fourth aspects, the silicone has a viscosity before emulsification (as measured on a Brookfield RV4 viscometer at 25° C. using spindle No.4 at 100 rpm) of from 10,000 cSt to 1,000,000 cSt, preferably from 30,000 cSt to 750,000 cSt, more preferably from 40,000 cSt to 400,000 cSt, most preferably 45,000 cSt to 250,000 cSt, eg 45,000 cSt to 200,000 cSt.

Preferably, in compositions according to the first and third aspects of the present invention and certainly in those according to the second and fourth aspects of the invention, emulsification is effected using one or more cationic surfactants, preferably having a non-halogen counter-ion.

The cationic emulsifiers are believed to enhance deposition of the silicone during use of the fabric softening composition. Preferred counter-ions include methosulphate, ethosulphate, tosylate, phosphate and nitrate. If a halogen counter-ion is used, it is preferably chloride.

For example, mixtures of one or more cationic and one or more nonionic surfactants can be used, or even nonionic surfactant(s) alone.

Preferably, the total of amount of emulsifying surfactant (s) is from 0.5% to 20%, preferably from 2% to 12%, more preferably from 3% to 10% by weight of the emulsion.

The emulsified silicone (as 100% active silicone) may be included in the fabric softener compositions in an amount of 3.5% to 15% by weight of the total composition (including the emulsion product containing the silicone emulsion), preferably 3.75% to 12%, more preferably 4% to 10%, most preferably 4.5% to 10%. However, it may be possible to include up to 20% by weight if it can be incorporated into the fabric softening composition without instability occurring therein. The total amount of silicone in the emulsion will generally be up to 70% by weight of the emulsion.

Preferably, the weight ratio of silicone to total emulsifying surfactant(s) is from 2.3:1 to 120:1, more preferably 3:1 to 120:1, for example from 3:1 to 30:1. Typical cationic surfactants are alkyl tri-methylammonium methosulphates and derivatives in which at least two of the methyl groups on the nitrogen atom are replaced by (poly)alkoxylated groups.

In the final product, the weight ratio of total fabric softening agent to total silicone is from 1:1 to 70:1, more preferably from 1.5:1 to 25:1, more preferably 2.5:1 to 10:1, eg 3:1 to 7:1.

Perfume

The compositions may comprise perfume. If present, the level of perfumes in the compositions may be 0.25% to 2% by weight, preferably 0.27% to 2%, such as 0.3% to 1.5%.

Optional Ingredients

The compositions may also contain one or more optional ingredients, selected from electrolytes, non-aqueous solvents, pH buffering agents, perfume carriers, fluorescers, colorants, hydrotropes, antifoaming agents, antiredeposition agents, polymeric and other thickeners, enzymes, optical brightening agents, opacifiers, anti-shrinking agents, auxiliary anti-wrinkle agents, anti-spotting agents, germicides, fungicides, anti-oxidants, anti-corrosion agents, drape imparting agents, antistatic agents, sunscreens, colour care agents and auxiliary ironing aids.

The preferred product form is a liquid, more especially an aqueous liquid. In liquid products, a viscosity control agent may be included. Any viscosity control agent typically used with rinse conditioners is suitable, for example biological polymers such as Xanthum gum (Kelco ex Kelsan and Rhodopol ex Rhone-Poulenc). Synthetic polymers may also be used as viscosity control agents e.g. polyacrylic acid, poly vinyl pyrolidone, polyethylene, carbomers, polyethylene, polyethylene glycols and cellulose-based thickeners such as hydroxy-ethyl cellulose modified to include long chain substituent groups. Also suitable as viscosity modifiers are decoupling polymers and deflocculating polymers.

It is preferred that the compositions are substantially free of bleaches.

Product Form

However, the compositions may be in any form conventionally used for fabric softening compositions for example, powder, paste or gel. It is preferred if the final product itself is a liquid and especially an aqueous emulsion, preferably a macro-emulsion and not a micro-emulsion, containing suspended fabric softener and emulsified silicone droplets.

Compositions

A fabric softening composition within the scope of the present invention may comprise 8 to 50% by weight of a cationic fabric softening agent; and perfume; and 3.5 to 15% by weight of an emulsified silicone (all weights being of the total weight of the composition) the silicone having been emulsified with one or more cationic surfactants to form a macro-emulsion with the viscosity of the silicone before emulsification being from 10,000 cSt to 400,000 cSt, preferably from 20,000 cSt to 350,000 cSt, more preferably from 25,000 cSt to 250,000 cSt.

Another fabric softening composition with the scope of the invention may comprise 8 to 50% by weight of a cationic fabric softening agent; and perfume; and 3.5 to 15% by weight of an emulsified silicone (all weights being of the total weight of the composition) the median droplet size of the emulsified silicone being at least 0.2 $\mu$m, preferably at least 0.25 $\mu$m, more preferably at least 0.39 $\mu$m, preferably also no greater than 25 $\mu$m and the silicone being emulsified with an emulsifier comprising one or more cationic surfactants.

EXAMPLES

Example A

A dimethyl-terminated polydimethylsiloxane (PDMS) having a viscosity of 60,000 cSt was formulated as an aqueous emulsion thus in

| Component | % wt |
|---|---|
| PDMS | 60 |
| COCOTMAMS (1) | 3.5 |
| COCOPEMAMS (2) | 1.9 |
| Water, preservatives | to 100 |

(1) coconut trimethylammonium methosulphate
(2) coconut pentaethoxymethylammonium methosulphate

Examples 1 and 2

The emulsion of Example A was included in dilute (Example 1) and concentrate (Example 2) forms of fabric softener compositions, in which amounts are % by weight of the total composition:

| Component | Example 1 (Dilute) | Example 2 (Concentrate) |
|---|---|---|
| Cationic Softener (3) | 4.7 | 12.7 |
| Coconut 20 EO Non-ionic | 0.1 | 0.7 |
| Tallow Alcohol | — | 0.7 |
| Silicone Anti-foam | 0.03 | 0.015 |
| Cetyl hydroxyethyl cellulose | 0.03 | — |
| Proxel (4) | 0.16 | 0.15 |
| Pearlescer (mica) | 0.1 | 0.18 |
| Dye | 0.0015 | 0.0048 |
| Perfume | 0.32 | 0.95 |
| (Emulsifier) | (1.67) | (5.0) |
| Silicone PDMS | 1.0 | 3.0 |
| COCOTMAMS | 0.058 | 0.17 |

-continued

| Component | Example 1 (Dilute) | Example 2 (Concentrate) |
|---|---|---|
| COCOPEMAMS | 0.032 | 0.1 |
| Water, other preservatives | to 100 | to 100 |

(3) Mixture of 1,2 bis[hardened tallowoxy]-3-trimethyl ammonium propane chloride and free fatty acid in a weight ratio of 6:1.
(4) Preservative

Example 3 (Performance Evaluation)

Compositions comprising by weight 12.7% of the cationic softener of Examples 1 and 2, 0.7% coconut 20 EO nonionic, 0.7% tallow alcohol and 3% polydimethylsiloxane (% active) obtained from different emulsions containing nonionic emulsifier and 50% by weight of the silicone active ingredient. To evaluate the first and third aspects of the present invention, the viscosity and median droplet sizes were varied between these different emulsions.

The nonionic-emulsified silicone emulsion was type HV600, available ex Dow Corning, but with the silicone viscosity and median droplet size being varied by the supplier, the other components being per the standard commercial product.

These formulations were evaluated in the rinse cycle as follows:

White cotton shirts were washed 4 times at 60° C. to remove any pre-existing treatments which would distort the results.

Wash/rinse/dry cycles were then carried out. The conditions were as follows:

Machine: Candy Aquaviva 1000

Temperature: 40° C.

Programme: Programme 5—Non-fast coloureds recommended for cotton

Water hardness: 13° FH (Wirral water)

Main wash product: 150 g Persil Bio powder via shuttle

Rinse products: 35 gm of a control composition containing 3% PDMS with a viscosity of 60,000 cSt before emulsification OR 35 gm of a test composition containing 3% PDMS with viscosities before emulsification in the range 1,000 cSt to 750,000 cSt Washload: 10 shirts Drying: Hung on rails indoors 2 extra shirts were added to the washes so that extraction could be carried out and silicone deposition estimated. These were split evenly over the washes.

Desized cotton poplin monitors were included for each product; 3×20 cm by 20 cm and 3×50 cm by 100 cm desized cotton poplin monitors were also included for measurement of fabric physical properties.

The garments were assessed for:

1. Degree of creasing before ironing
2. Ease of ironing, Using steam

The degree of creasing was assessed by paired comparisons between garments rinsed in the test and control products respectively. The garments were placed in the viewing cabinet and the assessor was asked Which is the least creased? For the ease of ironing comparison, the panellist ironed two shirts using steam and was asked Which is the easiest to iron? The irons used were Philips Azur 50 set at the temperature for cotton. 100 ml of water was added for each panellist. The steam was set at maximum. Separate irons were used for each treatment to avoid possible transfer of rinse conditioner or silicone via the plate of the iron. The irons were washed and swapped halfway through the exercise to compensate for differences in the irons. Identical ironing boards were used.

The result obtained are summarised in the following table:

| | Emulsion Characteristics | | | | | |
|---|---|---|---|---|---|---|
| | Silicone | Median Droplet | Degree of creasing (sample size 40) | | Ease of ironing (sample size 20) | |
| | Viscosity (cSt) | Diameter (μm) | Score | Score (as %) | Score | Score (as %) |
| (a) | 1,000 | 0.5 | 14 | 35.0 | 8 | 40 |
| (b) | 60,000 | 0.5 | 20 | 50.0 | 10 | 50 |
| (c) | 60,000 | 5.0 | 20 | 50.0 | 9 | 45 |
| (d) | 60,000 | 10.0 | 18 | 45.0 | 7 | 35 |
| (e) | 143,000 | 0.5 | 26 | 65.0 | 8 | 40 |
| (f) | 600,000 | 5.0 | 23 | 57.5 | 10 | 50 |
| (g) | 750,000 | 0.5 | 27 | 67.5 | 12 | 60 |
| (h) | 600,000 | 7.8 | 22 | 55.0 | 7 | 35 |

Sample (a) does not correspond to the invention, the viscosity being within the prior art range. All of samples (b)–(h) showed a marked improvement in degree of creasing over sample (a). All except (d), (e) and (h) showed a marked improvement over (a) in terms of ease of ironing.

Example 4 (Performance Evaluation)

To evaluate the second and fourth aspects of the present invention, a comparison of effects on silicone deposition and performance in anti-creasing and anti-ironing was performed using a base fabric conditioner formulation as control:

| Component | wt % |
|---|---|
| Cationic Softener (5) | 4.8 |
| Nonionic 20 EO | 0.1 |
| Tallow Alcohol | 0.6 |

(5) Di-ethoxy ester (tallow)-di-methylammonium chloride

To the control formulation was added a PDMS emulsion at an amount equivalent to 1% silicone based on the weight of the softener composition, the balance being water (with minor ingredients), the viscosity of the silicone being 60,000 cSt with a median droplet diameter of 0.5 μm and emulsified, either with cationic or nonionic surfactants:

| Cationic System | Nonionic System |
|---|---|
| Cetyl trimethyl ammoniumchloride (4.35%) + COCOPEMANS (1%) | HV600 (ex Dow Corning) |

The weights in the cationic system are expressed as % by weight of the emulsion. The HV600 product is the nonionic-emulsified silicone referred to in Example 3.

The products were dosed at 110 ml to a washing machine rinse cycle and both shirts and T-shirts were evaluated for anti-creasing and ease of ironing. The cationic and nonionic products were compared as a % of the control (i.e. minus silicone). Silicone deposition was evaluated by a standard method. The results obtained were as follows:

| Emulsifier System | T-Shirts Anti-crease Benefit % | Shirts Anti-crease Benefit % | T-Shirts Ironing Benefit % | Shirts Ironing Benefit % | T-Shirts Silicone Deposition % | Shirts Silicone Deposition % |
|---|---|---|---|---|---|---|
| Non-ionic | 35 | 53 | 75 | 62 | 47 | 79 |
| Cat-ionic | 57 | 80 | 85 | 70 | 86 | 98 |

In all cases, the cationic emulsion shows a marked improvement in silicone deposition, anti-creasing and ease of ironing.

What is claimed is:

1. A fabric softening composition comprising:

(a) about 4.8% by weight cationic fabric softening agent; and (b) an emulsified silicone;

wherein the viscosity of the silicone before emulsification is from about 60,000 cSt to 1,000,000 cSt, and the emulsion is a macro-emulsion.

2. A composition according to claim 1, wherein, in the emulsified silicone, the median droplet size is from 0.39 $\mu$m to 25 $\mu$m.

3. A method of manufacturing a composition according to claim 2, the method comprising obtaining an emulsion in the form a macro-emulsion of a silicone having a viscosity of from 60,000 cSt to 1,000,000 cSt and admixing the emulsion with a cationic fabric softening agent, and optionally with any other component(s).

4. A composition according to claim 1 wherein the silicone is emulsified with an emulsifier comprising one or more cationic surfactant.

5. A composition according to claim 1, wherein in the emulsion, emulsifying surfactant is present from 0.5% to 20% by weight of the total composition, and silicone to total emulsifying surfactant at a ratio of 3:1 to 120:1.

6. A composition according to claim 1, wherein the cationic fabric softening agent is selected from quaternary ammonium and ester-linked quaternary ammonium compounds.

7. A composition according to claim 6, wherein the cationic fabric softening agent is selected from 1,2 bis [hardened-tallowoxy]-3-trimethylammonium propane chloride, diethoxy ester(tallow)dimethyl ammoniumchloride, dihardened-tallow-dimethyl ammoniumchloride and di-(tallowyloxyethyl)methyl hydroxyethyl methosulphate, and mixtures thereof.

8. A composition according to claim 1, wherein the total amount of cationic fabric softening agent is 0.5% to 35% by weight of the total composition.

9. A composition according to claim 1, wherein the silicone is a poly-di-$C_{1-6}$alkylsiloxane (preferably polydimethylsiloxane) end-terminated by tri-$C_{1-6}$alkylsilyl (preferably trimethylsilyl) groups or by hydroxy-di-$C_{1-6}$ alkylsilyl preferably hydroxy-dimethylsilyl) groups or a mixture of both.

10. A composition according to claim 1, wherein total fabric softening agent weight to total silicone weight is from 1:1 to 70:1.

11. A method of manufacturing a fabric softening composition according to claim 1, the method comprising obtaining an emulsion in the form of an emulsion of a silicon having a viscosity of from 60,000 cSt to 1,000,000 cSt, the median droplet size of the silicone in the emulsion being at least 0.2 $\mu$m, and the silicone is emulsified with an emulsifier comprising one or more cationic surfactants, and admixing said emulsion with a cationic fabric softening agent, and optionally with any other component(s).

12. A method of softening a fabric, the method comprising applying to that fabric, a composition according to claim 1.

13. A fabric softening composition comprising:

(a) about 4.8% by weight cationic fabric softening agent; and (b) an emulsified silicone;

wherein the median droplet size of the silicone in the emulsion is at least 0.2 $\mu$m, and the silicone is emulsified with an emulsifier comprising one or more cationic surfactant wherein the viscosity of the silicone before emulsification is from about 60,000 cSt to 1,000,000 cSt.

14. A composition according to claim 13, in which the cationic surfactant(s) is/are selected from those having a non-halogen counter-ion and/or selected from those having a nitrogen atom with (poly)alkoxylated groups.

* * * * *